US005709484A

United States Patent [19]

Dorner

[11] Patent Number: 5,709,484

[45] Date of Patent: Jan. 20, 1998

[54] APPARATUS FOR DOUBLE-SIDED PRINTING OF IDENTIFICATION CARDS

[75] Inventor: Frank Dorner, Vienna, Austria

[73] Assignee: Kunz GmbH, Vienna, Austria

[21] Appl. No.: 639,093

[22] Filed: Apr. 24, 1996

[30] Foreign Application Priority Data

Apr. 24, 1995 [DE] Germany ..... 195 14 999.8

[51] Int. Cl.[6] ..... B41J 3/60; B41J 13/12

[52] U.S. Cl. ..... 400/188; 400/120.01; 400/521

[58] Field of Search ..... 400/188, 521–525, 400/536, 120.01

[56] References Cited

U.S. PATENT DOCUMENTS 5,326,179 7/1994 Fukai et al. ..... 400/120
5,410,136 4/1995 McIntire et al. ..... 235/380

FOREIGN PATENT DOCUMENTS 3907415 9/1990 Germany .
58-167347 10/1983 Japan .

*Primary Examiner*—Edgar S. Burr
*Assistant Examiner*—Dave A. Ghatt
*Attorney, Agent, or Firm*—Flynn, Thiel, Boutell & Tanis, P.C.

[57] ABSTRACT

An apparatus for double-sided printing of identification cards (1) has a printing unit (2) with a thermal printhead (17), a card transport device, an input sensor (8) and an output sensor (9) as well as a reversing unit (3) for reversing and further transporting the printed card (1) which is provided with a rotor (36) with a rotating card transport device. The card transport device on the rotor (36) is controlled so that it feeds the card (1) printed on one side and turned by 180° to the printing unit (2) again without changing its direction of rotation. The card transport apparatus of the printing unit (2) is switchable from the forward to the return transport direction (A and B, respectively) for return transport of the card (1) from the output sensor (9) to the input sensor (8). When the card (1) reaches the input sensor (8) upon return transport, the card transport device is switched back for printing the other side of the card (1) and feeding it to the reversing unit (A) again.

18 Claims, 2 Drawing Sheets

APPARATUS FOR DOUBLE-SIDED PRINTING OF IDENTIFICATION CARDS

BACKGROUND OF THE INVENTION

This invention relates to an apparatus for double-sided printing of identification cards, in particular cards made of plastic.

Such an apparatus is known. It has two printing units. One printing unit is used to print one side of the card, whereupon the card is reversed in the reversing unit and fed to the second printing unit for printing the other side. The two printing units make the known apparatus costly. It also requires quite a lot of space.

"Patent Abstracts of Japan M-267" or JP 58-167347 A discloses a copying machine wherein the copying paper, after being printed on the front in the copying unit, is fed via a transport device to a reversing unit which is formed as a plate rotatable around an axis extending in the direction of paper transport. The reversed paper thus passes into the copying unit for printing the back with the same leading edge as for printing the front. According to DE 3907415 A1 the cards are normally fed automatically to a thermal printer from a stack. To permit them to be drawn in by hand as well, however, the transport drive can be reversed.

The problem of the invention is to provide a fully automatic apparatus for double-sided printing of identification cards which has a simple structure while requiring little space.

SUMMARY OF THE INVENTION

The invention is based on the general idea of connecting to a printing unit with a thermal printhead a card reversing unit which feeds the card to the printing unit again after reversal, the printing unit being designed so that it can also draw in the card from its back and subject it to a new printing operation.

The inventive apparatus has only one printing unit. It is thus much more cost-effective and more space-saving than the known apparatus for double-sided printing of cards. The inventive apparatus is therefore suitable in particular for local issuing of cards printed on both sides, i.e. when small piece numbers of identification cards are issued at many places.

An identification card refers here both to an identity card, i.e. a card permitting identification of its owner or identifying him as the member of a group, and to a key card, i.e. a card permitting the owner to utilize certain services.

The thermal printhead consists of a row of heating elements extending perpendicular to the direction of card transport, with a density of for example 100 heating elements per cm or more. That is to say, the distance between the centers of two adjacent heating elements is 0.01 mm or less. The heating elements preferably extend along the edge of a ceramic substrate.

The heating elements are individually drivable with a computer. The thermal printhead can write in two coordinates, one coordinate extending in the direction of card transport and the other perpendicular thereto. Transport of the card is controlled and clocked with a stepping motor which moves the card past the row of heating elements in steps corresponding to the density of the heating elements, i.e. steps of 0.01 mm or less. The card is thereby pressed against the heating elements with a counterpressure roll.

For printing identification cards made of plastic or identification cards coated with plastic, one provides a color transfer foil which is moved through between the card and the thermal printhead and pressed by the mating roll both against the heating elements and against the card. The color transfer foil has a color transfer layer which adheres to the plastic card surface when heated by the heating elements. The color transfer layer has a thermoactive adhesive. This layer can be of two-layer design, i.e. consist of a color layer and a thermoactive adhesive layer on the outside or of a mixture of coloring pigments and the thermoactive adhesive.

The color transfer foil can be formed in particular by a hot-stamped foil which consists in the simplest case of a carrier foil and the color transfer layer. A parting agent layer is generally provided between the color transfer layer and the carrier foil.

For a hot-stamped foil to be used as a color transfer foil, the thermoactive adhesive must begin to melt the plastic surface of the card. Accordingly the cards preferably consist of a plastic which softens on the surface at the temperature reached by the hot-stamped foil heated by the heating elements, in particular polyvinyl chloride, ABS or polypropylene.

For producing a color print one can use a heat transfer foil whose color transfer layer consists of successive segments of the colors cyan, magenta, yellow and black. Repeated transport of the card along the thermal printhead with a different color segment of the color transfer layer and accordingly driven heating elements in each case gives rise to a color print, namely a CMYK picture, through superimposition of the halftone dots on the card.

The transport device of the printing unit can be formed by pairs of rolls disposed in the direction of card transport at a distance which is smaller than the length of the card. Each pair of rolls consists of a driven roll and an idle roll. The driven rolls of the pairs of rolls are driven for example via gearwheels by the stepping motor. It is also possible to use a circulating transport belt instead of pairs of rolls. The mating roll pressing the card against the thermal printhead can then be disposed on the half of the belt facing the printhead, namely on the side of this half of the belt facing away from the printhead.

The card transport device of the printing unit is driven by at least two sensors, namely an input sensor which switches on the stepping motor of the card transport device when a card to be printed is fed to the printing unit from the input side, and an output sensor which switches off the stepping motor when the card leaves the printing unit toward the reversing unit.

The card transport device fastened to the rotor of the reversing unit can consist for its part of at least two pairs of rolls disposed at a distance which is smaller than the length of the card, or a circulating transport belt against which the card is pressed with idle rolls.

An input sensor and an output sensor are provided on the card transport device of the reversing unit. When the card printed on one side coming from the printing unit reaches the input sensor of the card transport device of the reversing unit, the motor of the card transport device of the reversing unit is switched on.

When the card printed on one side reaches the output sensor the card transport device is switched off and the reversing motor switched on to turn the rotor by 180°.

After a rotor turn by 180°, which can be detected by sensors between the rotor and the rotor housing, the card transport device is switched back on and the card printed on one side fed to the printing unit again, with no change in the direction of circulation of the card transport device.

If the identification card is provided with an encodable integrated microcircuit, the contacts for coding the microcircuit can be fastened to the rotor of the reversing unit. This exploits the time for reversing the card for coding the microcircuit, on the one hand, and makes it possible to dispense with a separate contacting device with its own transport device, sensors, etc., on the other hand.

The sensors at the printing unit and the reversing unit are preferably formed by light barriers.

According to the invention, the card printed on one side is printed on the other side by the same printing unit after reversal in the reversing unit. For this purpose, the card transport device of the printing unit is designed so that the reversed card printed on one side is transported back from the output sensor past the printhead to the input sensor of the printing unit. That is to say, the output sensor of the printing unit switches on the stepping motor in the opposite direction of rotation and, when the card printed on one side reaches the input sensor of the printing unit, the latter switches the stepping motor to the other direction of rotation so that the card is fed to the thermal printhead in the forward transport direction again for printing the other side of the card.

In particular if one uses a heat transfer band, which travels in the forward transport direction between the thermal printhead and the card during printing, it is advantageous to increase the distance between the thermal printhead, against which the heat transfer band lies, and the card so that the card is not pressed against the heat transfer foil during return transport from the output sensor to the input sensor of the printing unit. For this purpose the counter-pressure roll and/or the thermal printhead are formed so as to be movable away from each other, for example by lowering the counterpressure roll or lifting the thermal printhead.

That is to say, the printing of cards takes place in the inventive apparatus only in the forward transport direction, since the entire printing control including the take-up roll for the heat transfer foil is designed only for one direction of card transport.

After the card has been printed on both sides it is fed to the reversing unit again. It can be outputted unreversed or reversed by the reversing unit.

In the former case the card transport device of the reversing unit, after being switched on by the input sensor, transports the card through the rotor of the reversing unit and after the card has left the transport device the output sensor of the reversing unit switches off the transport device.

If the front of the cards is printed first and then the back in this variant, the cards are deposited the wrong way round, i.e. in a stack with the back on top or in front. The main information of the card, such as the name and photo of the card owner, which is generally printed on the front of the card is thus invisible, since the front is on the side facing away from the viewer. In this variant the back of the card is therefore preferably printed first and then the front.

However, if the card printed on both sides is reversed one obtains a correct deposit, i.e. the card is deposited with the front on top or in front if the front of the card is printed first and then the back.

The card issuing unit need not be disposed directly after the reversing unit. The cards printed on both sides can instead be fed from the reversing unit to further processing units, for example an embossing unit which embosses alphanumeric data raised from the card surface with embossing letters.

BRIEF DESCRIPTION OF THE DRAWINGS

In the following an embodiment of the inventive apparatus will be explained more closely with reference to the schematic drawing, in which.

DETAILED DESCRIPTION

Figure 1:
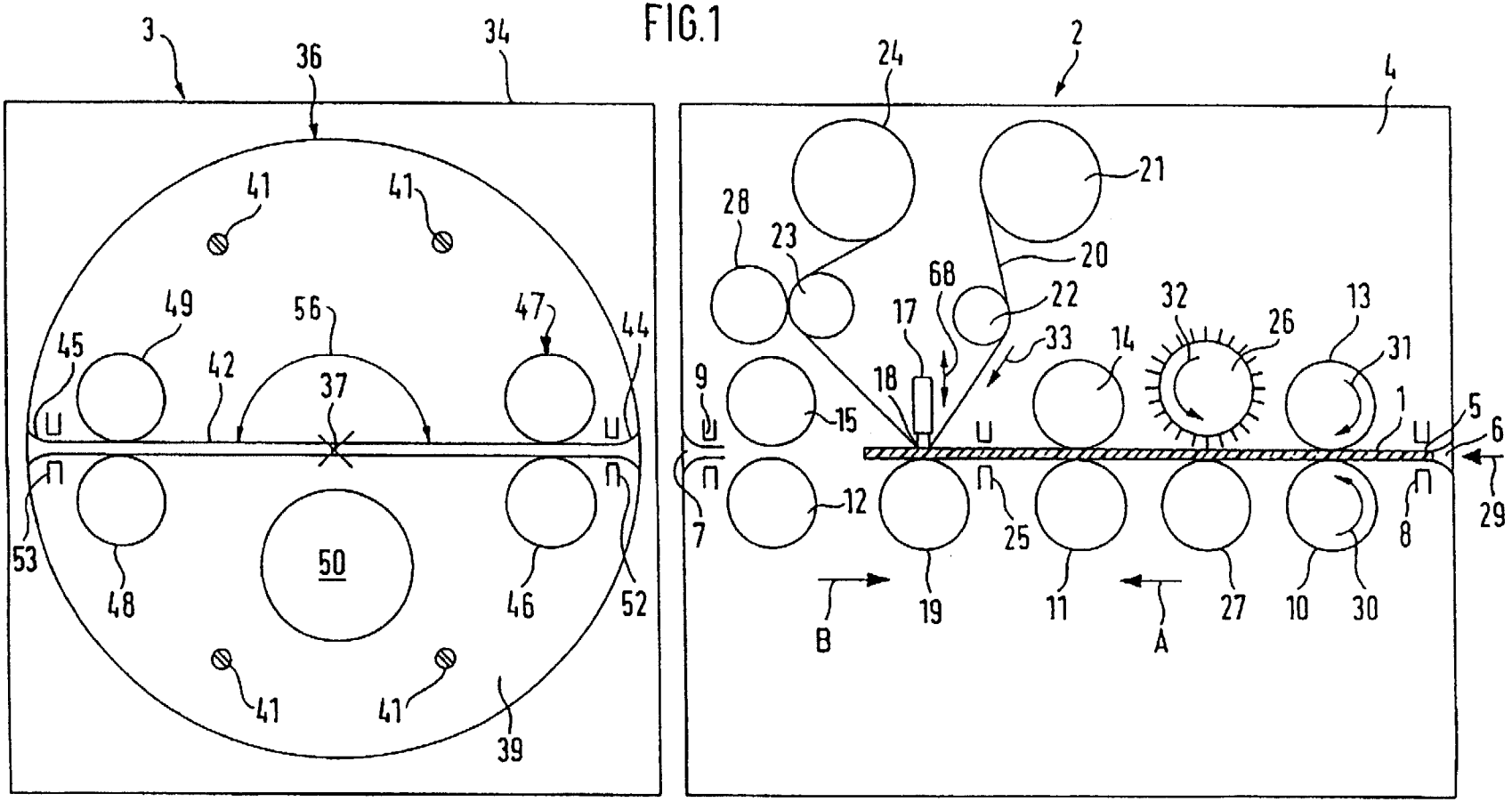
FIG. 1 shows a longitudinal section through the printing unit and the reversing unit of the apparatus, the card to be printed being located in the printing unit.

According to FIG. 1 the apparatus for double-sided printing of plastic identification card 1 consists of printing unit 2 and directly following reversing unit 3.

Printing unit 2 has a housing with two side walls, only back side wall 4 being visible in FIG. 1.

At the input-side and output-side ends the side walls are provided with guides 5 which widen out in the form of funnels 6 and, respectively, 7 for introduction of the longitudinal edges of card 1. The two side plates on both sides of card 1 then perform the lateral guidance. At the input-side and output-side ends sensors 8, 9 are provided, respectively.

The device for transporting card 1 has three rolls 10, 11, 12 on one, lower side of card 1 and three rolls 13, 14, 15 on the other, upper side of card 1. Rolls 10, 11, 12 are driven via a gear mechanism (not shown) by a stepping motor (not shown) and form with rolls 13, 14, 15, which are idle, pairs of rolls through which card 1 is guided to be moved from input sensor 8 to output sensor 9 in the direction of arrow A (forward and transport direction). The distance between pairs of rolls 10, 13 and 11, 14 and between 11, 14 and 12, 15 is dimensioned so that card 1 is always grasped by at least one pair of rolls.

Thermal printhead 17 is disposed between the two pairs of rolls 11, 14 and 12, 15 on one, upper side of card 1. Thermal printhead 17 is formed as an upright plate and has heating elements 18 on its side facing card 1. Heating elements 18 arranged in a row which extends perpendicular to transport direction A. Heating elements 18 are individually drivable with a computer (not shown).

Idle counterpressure roll 19 is disposed on the side of card 1 opposite thermal printhead 17.

For printing, heat transfer foil 20 is provided which is wound off supply roll 21 and fed via deflecting roll 22 around the lower edge of thermal printhead 17 with heating elements 18 and then via deflecting roll 23 to take-up roll 24 which is driven by a motor (not shown) to keep foil 20 tight on the side of thermal printhead 17 facing take-up roll 24.

Card 1 is pressed by counterpressure roll 19 against heating elements 18 of thermal printhead 17 through the intermediary of heat transfer foil 20.

Heating elements 18 are disposed on thermal printhead 17 for example at a distance of approx. 0.008 mm from mid heating element to mid heating element. The stepping motor then rotates rolls 10, 11, 12 for example so that card 1 is likewise transported in steps of approx. 0.008 mm in the direction of arrow A. One cross row of color dots per step can be transferred to the card surface from heat transfer foil 20 by individually drivable heating elements 18. The holding time for color transfer between the transport steps is generally between 0.2 and 2 ms, for example 0.5 ms.

Further sensor 25 is disposed before thermal printhead 17 on the side facing input sensor 8. Sensors 8, 9 and 25 are preferably each formed from two light barriers which are disposed on one and the other side of the card.

Brush roll 26 driven by the stepping motor via the gear mechanism is further disposed between the two pairs of rolls 10, 13 and 11, 14, said brush roll rotating the opposite way to rolls 10, 11 and 12 in the direction of arrow 32 during transport of card 1 and cooperating with idle mating roll 27. To remove particles and similar dirt from the card surface one can provide along with brush roll 26 a roll (not shown) with an adhesive surface to which the dirt particles adhere.

To perform a color print with color foil 20 which has segments of color transfer material in the primary colors, magenta, cyan, yellow and black, running wheel 28 is provided for measuring the length of transported foil 20 and thus exactly determining the position of the individual segments.

When card 1 is fed to input 29 for printing, light barrier 8 switches on the stepping motor so that rolls 10, 11, 12 rotate with their mating rolls 13, 14, 15 according to arrows 30, 31.

Brush roll 26 rotates in the opposite direction according to arrow 32.

In this way the card is transported from input sensor 8 to thermal printhead 17. It thereby pulls heat transfer foil 20 through under thermal printhead 17 in the direction of arrow 33. Foil 20 is transported by card 1. Motor-driven take-up roll 24 serves only to prevent a slack on the side of thermal printhead 17 facing take-up roll 24.

Sensor 25 before thermal printhead 17 permits exact positioning of the place on card 1 where thermal printhead 17 starts printing the card.

When card 1 leaves printing unit 2, sensor 9 at the output switches off the stepping motor.

Figure 2:
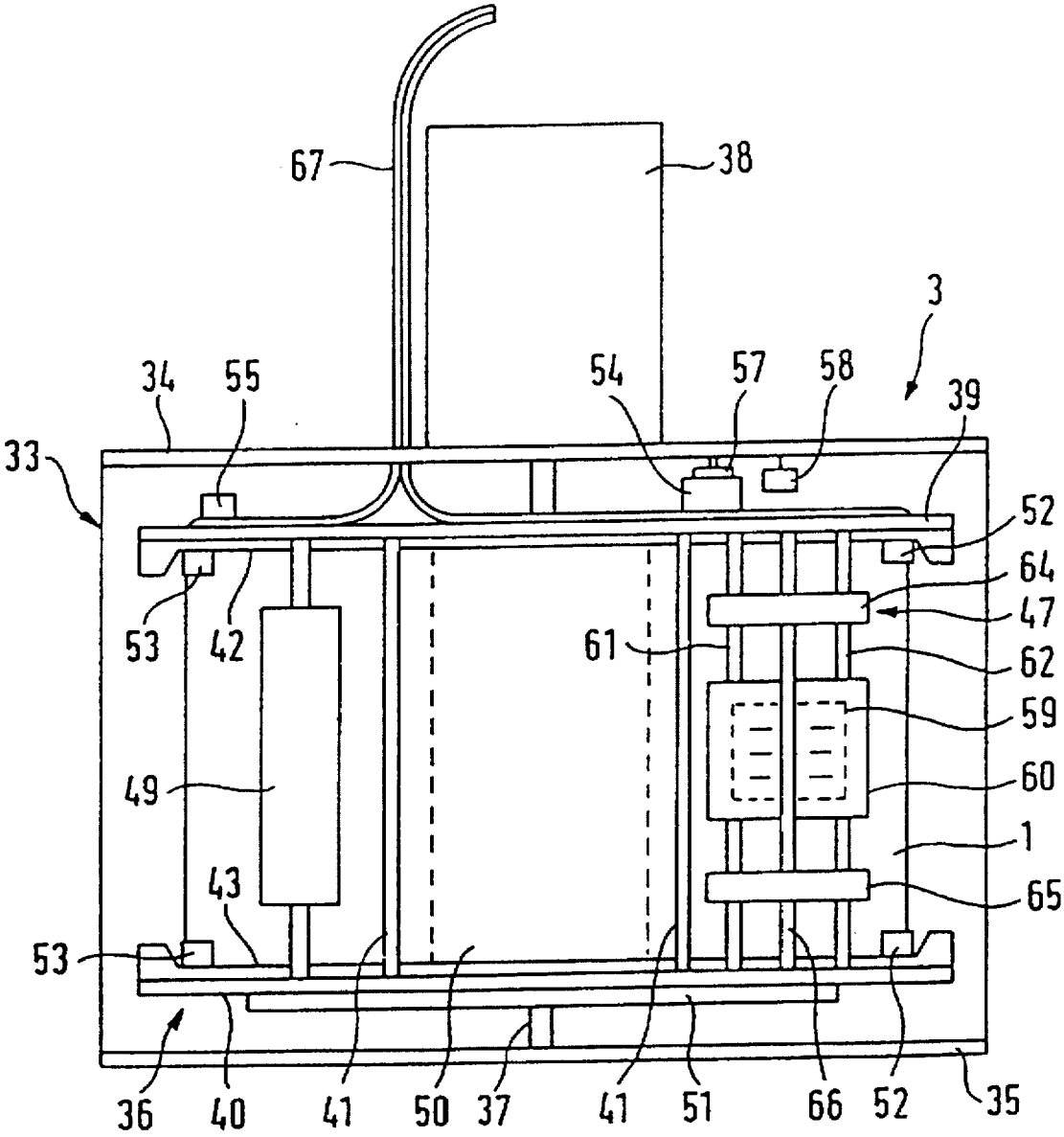
FIG. 2 shows a plan view of the reversing unit according to FIG. 1 but with a card.

Reversing unit 3 consists according to FIGS. 1 and 2 of housing 33 with two side walls 34, 35 between which rotor 36 is rotatably mounted with shaft 37 which extends perpendicular to transport direction A and is driven by reversing motor 38.

Rotor 36 consists of two disk-shaped side walls 39, 40 which are interconnected by a plurality of tie rods 41.

Both side walls 39, 40 of rotor 36 have channel-shaped guides 42, 43 for card 1 which are provided with flares 44, 45 on the input side and output side for introduction of card 1 into guides 42, 43 from one and the other side.

For transporting card 1 within reversing unit 3, pairs of rolls 46, 47 and 48, 49 are provided on rotor 36 on guides 42, 43 on one and the other side, respectively, which are driven via gear mechanism 51 schematically shown in FIG. 2 by motor 50 fastened to rotor 36.

Both rolls 46, 47 and 48, 49 of each pair of rolls are preferably driven so that the weight of card 1 cannot change the transport speed during reversal.

Card 1 is taken over with pair of rolls 46, 47 when it leaves printing unit 2 via output sensor 9 after being printed on the upper side by thermal printhead 17.

Sensors 52, 53 are fastened to rotor 36 on both sides of the card transport device of reversing unit 3. As indicated by FIG. 2, each sensor 52, 53 consists of two light barriers on one and the other long side of card 1, respectively. Each light barrier is composed for its part of a light source on one side of card 1 and a photocell on the other side thereof.

Rotor 36 is rotatable by 180° in one and the other direction according to double arrow 56 in FIG. 1 with reversing motor 38. Stops (not shown) are provided for limiting the travel to 180° between the rotational positions.

On wall 39 of rotor 36 there are two noses 54, 55 which cooperate with two light barriers 57, 58 fastened to side wall 34 of housing 33.

When card 1 is fed from printing unit 2 to sensor 52 of reversing unit 3 the latter switches on transport motor 50 so that transport rolls 46, 47 transport card 1 further until it reaches sensor 53 at the other end of rotor 36. Sensor 53 then switches transport motor 50 off and reversing motor 38 on so that rotor 36 is rotated by 180° . The rotational position of rotor 36, i.e. whether sensor 52 faces printing unit 2 or sensor 53 does, is detected by sensors 57, 58 which cooperate as light barriers with noses 54 and 55.

If the inventive apparatus is used for printing identification cards 1 additionally having a chip, i.e. encodable integrated microcircuit 59 whose contour is shown as a dashed rectangle in FIG. 2, reversing unit 3 has a device for contacting chip 59 which is fastened to rotor 36, as shown in FIG. 2. This device can consist of plate 60 whose side facing card 1 bears rubbing contacts which are driven by a computer (not shown) to charge chip 59 while card 1 is being reversed in reversing unit 3. For fastening chip contacting device 60 one can provide bars 61, 62 between the two rotor walls 34, 35.

So that enough space is available for chip contacting device 60 in the area of chip 59 of card 1 disposed between sensors 52 and 53, roll 47 is divided and formed by two disk-shaped rolls 64 and 65 on axle 66.

Electricity is supplied to the electric devices on rotor 36, i.e. motor 50, sensors 52, 53 and coding device 60, by a bundle of cables 67 which corotates with rotor 36.

When card 1 has been printed on one side by thermal printhead 17 of printing unit 2 according to FIG. 1, its chip 59 charged with chip contacting device 60 on rotor 36 of reversing unit 3 and the card reversed with the reversing unit, it is fed to printing unit 2 again to be printed on the other side. For this purpose transport motor 50 is switched over after card 1 is reversed, causing the card to be fed to output sensor 9 of printing unit 2 with no change in the direction of rotation of transport rolls 46 to 49, so that it is moved to input sensor 8 past printhead 17 according to arrow B. That is to say, output sensor 7 switches on the stepping motor in the opposite direction of rotation and, when card 1 printed on one side moving in the return transport direction according to arrow B reaches input sensor 8, the latter switches the stepping motor to the other direction of rotation so that the transport device feeds card 1 to thermal printhead 17 in the forward transport direction according to arrow A again for printing the other side of the card.

To prevent the card from touching heat transfer foil 20 during return transport from output sensor 9 to input sensor 8, thermal printhead 17 is formed so as to be movable up and down according to arrow 68, i.e. it is lifted during return transport of the card.

After card 1 has been printed on both sides it is fed to reversing unit 3 again. It can then be outputted by reversing unit 3 unreversed or reversed on the side of reversing unit 3 facing away from printing unit 2.

I claim:

1. An apparatus for double-sided printing of an identification card having an encodable chip thereon the apparatus comprising:

a printing unit having: a thermal printhead for printing on one side of a card at a time; a card transport device for moving the card past the thermal printhead in steps; an input sensor for switching on the card transport device when a card is fed to the printing unit; and an output sensor for switching off the card transport device as a card moves away from the printing unit; and a reversing unit for reversing a card, the reversing unit having: a rotor with a rotation axis extending perpendicular to the direction of card transport; a card transport device fastened to the rotor for drawing a card from the printing unit to the rotor and returning a card from the rotor to the printing unit; and a device for turning the rotor by 180° when a card is fed onto the rotor, the improvement wherein:

the card transport device of the reversing unit is formed on the rotor as a rotating transport device which is rotated in only a single direction to both draw a card onto the rotor and to return a rotated card to the printing unit; and the card transport device of the printing unit is switchable to allow the forward and return transport of a card wherein, the output sensor switches on the card transport device of the printing unit into the return transport direction when a rotated card printed on a first side is returned from the reversing unit and the input sensor switches back the card transport device to the forward transport direction after a rotated card is fed from the output sensor for printing a second side of a card with the thermal printhead and feeding a card printed on both sides back to the reversing unit.

2. The apparatus of claim 1, wherein the printing unit has a counterpressure roll for pressing a card against the thermal printhead, and at least one of the thermal printhead and the counterpressure roll is selectively movable away from the other to release the pressure of a card against the thermal printhead.

3. The apparatus of claim 1, wherein the card transport device and the rotor of the reversing unit are controlled so that a card printed on both sides is reversed before its further transport.

4. The apparatus of claim 1, wherein a chip contacting device is disposed on the rotor of the reversing unit for coding an encodable chip on a card.

5. The apparatus of claim 2, wherein the thermal printhead is configured to be moved relative to the counterpressure roll.

6. The apparatus of claim 4, wherein said chip contacting device is configured to code data on an encodable chip simultaneously with the rotation of a card by the reversing unit.

7. An apparatus for printing and encoding an identification card having opposed sides and an encodable chip attached thereto, said apparatus comprising:

a print unit having a static printhead positioned to print on one side of an identification card at a time;

a first card transport device for moving an identification card along a path of travel past said printhead, said first card transport device being configured to move an identification card in a forward direction past said printhead and in a reverse direction, opposite the forward direction, past said printhead;

a reversing unit positioned adjacent said print unit for receiving an identification card after an identification card is moved in the forward direction past said printhead, said reversing unit including: a rotor with a rotational axis extending perpendicular to the path of travel of an identification card; an actuator for rotating said rotor and an identification card 180°; and a second card transport device attached to said rotor for transferring an identification card from said print unit to said rotor and for transferring an identification card from rotor back to said print unit; and a chip encoding assembly attached to said rotor, said chip encoding assembly being positioned to bear against an encodable chip when an identification card is received on said rotor and that is configured to load data onto an encodable chip.

8. The apparatus of claim 7, wherein said chip encoding assembly is configured to load data onto an encodable chip simultaneously with the rotation of said rotor and the identification card.

9. The apparatus of claim 7, wherein said printhead is a thermal printhead.

10. The apparatus of claim 7, wherein: said print unit has an input side located distal from said reversing unit, wherein an identification card is inserted into said input side; said print unit has a output side located adjacent said reversing unit, wherein an identification card is transferred from said print unit to said reversing unit across said output side; an input sensor is attached to said input side of said print unit, said input sensor being configured to generate input sensor signals representative of the position of an identification card relative to said input sensor; an output sensor is attached to said output side of said print unit, said output sensor being configured to generate output sensor signals representative of the position of an identification card relative to said output sensor; and said first transport device receives said input sensor signals and said output sensor signals and is configured to regulate the forward and reverse movement of an identification card as a function of said input sensor signals and said output sensor signals.

11. The apparatus of claim 7, wherein said second card transport device includes a rotating member for moving an identification card, wherein said rotating member is rotated only in a single direction to both transfer an identification card from said print unit to said rotor and to transfer an identification card from said rotor back to said print unit.

12. The apparatus of claim 7, wherein said print unit includes a counterpressure roll that is positioned adjacent said printhead for urging an identification card against said printhead.

13. The apparatus of claim 12, wherein one of said printhead or said counterpressure roll is moveable relative to the other.

14. A method of printing and encoding an identification card, said method including the steps of:

providing an identification card having first and second opposed sides and an encodable chip thereon;

moving said identification card in a first pass across a printhead so that said first side of said identification card is moved past said printhead and wherein said printhead is actuated to print on said first side of said identification card;

rotating said identification card 180°;

at least partially simultaneously with said rotation of said identification card, encoding data onto said encodable chip; and moving said identification card in a second pass across said printhead so that said second side of said identification card is moved past said printhead and wherein said printhead is actuated to print on said second side of said identification card.

15. The method of claim 14, wherein said printhead performs thermal printing on said first and second sides of said identification card.

16. The method of claim 14, wherein after said second side of said identification card is printed, said identification card is subjected to a second 180° rotation step.

17. The method of claim 14, wherein:

during said first pass of said identification card across said printhead, said identification card is moved in a forward direction;

after said identification card is rotated 180°, said identification card is moved in a reverse direction, opposite the forward direction, across said printhead during which said printhead is not actuated; and after said identification card is moved in the reverse direction across said printhead, said identification card is moved in said second pass in the forward direction across said printhead.

18. The method of claim 17, wherein: when said identification card is moved across said printhead in said first and second passes, said identification card is pressed against said printhead; and when said identification card is moved in the reverse direction across said printhead, said identification card is not pressed against said printhead.

* * * * *